United States Patent [19]

Grimes

[11] 4,135,172

[45] Jan. 16, 1979

[54] ELECTRICAL INDUCTIVE APPARATUS

[75] Inventor: Jerry W. Grimes, Danville, Va.

[73] Assignee: Westinghouse Electric Corp., Pittsburgh, Pa.

[21] Appl. No.: 846,942

[22] Filed: Oct. 31, 1977

[51] Int. Cl.[2] ..... H01F 27/26; H01F 27/30

[52] U.S. Cl. ..... 336/197; 336/210

[58] Field of Search ..... 336/92, 210, 197, 223; 310/214, 217

[56] References Cited

U.S. PATENT DOCUMENTS

| | | | |
|---|---|---|---|
| 1,539,878 | 6/1925 | Skinner | 336/197 |
| 1,905,790 | 4/1933 | Brand | 336/210 X |
| 3,040,280 | 6/1962 | Wiederkehr | 336/92 |
| 3,344,381 | 9/1967 | Koepke | 336/92 |
| 3,419,836 | 12/1968 | Aldridge, Jr. | 336/210 |
| 3,792,395 | 2/1974 | Michel | 336/223 X |
| 3,792,397 | 2/1974 | Reinemann | 336/92 |
| 4,055,826 | 10/1977 | Franz | 336/197 X |

*Primary Examiner*—Thomas J. Kozma
*Attorney, Agent, or Firm*—D. R. Lackey

[57] ABSTRACT

Electrical inductive apparatus having improved support structure for a magnetic core and winding assembly. The support structure includes end plate assemblies, each having a substantially tubular cross-sectional configuration, which are disposed in abutting relation with the outermost turns of the winding assembly and joined to top and bottom end frames disposed adjacent to the top and bottom yokes of the magnetic core. In another embodiment, upper core braces are situated above the winding and are adjustably disposed between the outermost legs of the magnetic core and the end plate assemblies. Lower core braces are disposed below the winding and include members which are disposed in abutting relation with the core legs and joined to bottom end frame.

7 Claims, 5 Drawing Figures

ELECTRICAL INDUCTIVE APPARATUS

BACKGROUND OF THE INVENTION

1. Field of the Invention

This invention relates, in general, to electrical inductive apparatus and, more specifically, to support structures for electrical transformers.

2. Description of the Prior Art

In conventional constructions of electrical inductive apparatus, such as electrical transformers, the magnetic core is generally comprised of top and bottom yokes which connect one or more leg sections on which an electrical winding assembly or coil is axially disposed. The magnetic core is formed of stacked laminations of magnetic material held in assemblied relation by top and bottom end frame members which are disposed along the top and bottom yokes, respectively.

In certain transformer constructions, such as those having core and coil assemblies with a rectangular cross-sectional configuration, additional side braces or end plates are connected between the top and bottom end frame members and are disposed in abutting relation with a portion of the outermost turn of the electrical winding assembly to prevent movement or rounding out of the rectangular winding under stresses incident to short circuit or transient conditions. As shown in U.S. Pat. No. 3,792,395, issued to G. Michel, and assigned to the assignee of this application, such end plates consist of thick steel slabs or plates which are welded to the top and bottom end frames adjacent opposing ends of the coil assembly to form a rigid support structure.

Although satisfactory in operation, such end plate construction poses problems in view of the recent trend to higher voltages and correspondingly higher ratings for electrical apparatus, such as transformers; which result in increased short circuit and transient forces acting upon the transformer. In view of these increased forces, the beam strength of the end plates must be increased in order to prevent the movement or rounding out of the windings of the transformer. The normal approach used to increase the strength of the end plates is to increase their thickness. However, this increases the overall weight of the transformer and results in higher shipping costs and handling difficulties. In addition, prior art type end plates require considerable machining to round off the sharp corners of the rectangular plate and thereby prevent corona inception at these points.

The trend toward higher voltages in electrical distribution systems also poses problems for the mechanical integrity of the magnetic cores of electrical inductive apparatus, such as transformers. In a typical construction, the yokes and legs of a magnetic core are joined together by a so called step-lap joint, such as that described in greater detail in U.S. Pat. No. 3,153,215 which is assigned to the assignee of the present application. In such a configuration, the joint between the mitered or diagonally cut ends of the legs and yokes in each layer of the core laminations are increasingly offset from the joints in adjacent layers in a stepped or progressive pattern. The increased forces acting upon this type of magnetic core, due to higher than normal operating voltages, result in movement or separation of the core legs relative to the yokes at the joint region. Prior art type support structures have proved to be insufficient in maintaining the integrity of the magnetic core under the higher operating voltages required and, thus, limit the maximum rating for rectangular core and coil type transformers.

In view of the foregoing discussion, it is desirable to provide an electrical inductive apparatus, such as a transformer having rectangular core and coils, that has a higher rating than previously attainable with this type of transformer construction.

In order to provide a transformer with a higher rating than previously attainable using prior art methods, it is of primary importance to eliminate or substantially restrict the movement of the winding and magnetic core incident to forces caused by short circuit and transient conditions. It would, thus, be desirable to provide a transformer having an improved support structure that provides increased strength to resist movement of the winding without a corresponding increase in the weight of such support structure. It would also be advantageous to provide a transformer having an improved support structure that resists or substantially eliminates movement of the legs of the magnetic core relative to the core yokes.

SUMMARY OF THE INVENTION

Herein disclosed in an electrical inductive apparatus having an improved support structure that permits an apparatus, such as a transformer, to be constructed with higher ratings than previously possible. The support structure includes top and bottom end frames disposed adjacent the top and bottom yokes of the magnetic core of the electrical inductive apparatus and first and second end plate assemblies each abutting a portion of the outermost turn of the winding and joined to the top and bottom end frames. Each end plate assembly has a substantially tubular cross-sectional configuration which forms a strong but lightweight member that provides increased strength for the support structure without a corresponding increase in weight. The tubular end plates are disposed in registry with a portion of the outermost turn of the winding and are welded to the top and bottom end frames to form a rigid support structure that resists movement of the winding and, in those transformer constructions utilizing core and coils having a rectangular cross-sectional configuration, prevents the rectangular winding from rounding out under forces incident to short circuit and transient conditions. The unique support structure for an electrical inductive apparatus disclosed herein provides additional strength that permits transformers to be constructed with higher ratings without a corresponding increase in weight which, therefore, reduces shipping costs and simplifies handling during assembly since the increased strength is achieved by increasing the depth or cross section of the end plate assemblies instead of increasing the thickness of the rectangular plate of prior art type end plates. In addition, corona inception is resisted since the tubular end plates present rounded corners to the conducting portions of the transformer which eliminates the need for extensive surface conditioning of the sharp edges of the slab end plate member employed previously.

Unique upper and lower core braces are also provided to resist movement or separation of the laminations of the core legs from the core yokes at the joint there-between caused by the higher forces acting upon transformers having rectangular core and coils when such transformers are constructed with higher ratings, above 5 MVA, than previously possible. The upper core braces are situated above the winding and are adjustably disposed between the outermost core legs and the end plate assemblies. Suitable adjustment means are provided to allow each upper core brace to be pressed against the core leg and thereby provide a rigid connection or brace between the core leg and the end plate assembly that prevents movement or separation of the core leg from the upper yoke during the operation of the electrical inductive apparatus. Besides preventing movement of the core leg, the unique upper core braces disclosed herein simplify the assembly of the support structure since the welding required to join the core brace to the end plate assembly, after final adjustments have been made, is not done directly over the winding thereby reducing the possibility of weld splatter falling into the winding and causing problems during subsequent operation of the electrical inductive apparatus. In addition, the tubular cross section of the end plate assemblies enables the upper core braces to be adjustably forced against the core leg to form a rigid support without the need for precision-shaped components.

Lower core braces are disposed below the winding and in abutting relation with the outermost core legs to resist movement thereof. The lower core braces include an insulating member disposed in registry with the core leg and a plate member adjoining the insulating member and suitably joined, such as by welding, to the bottom end frame to provide a solid brace that resists movement or separation of the core leg from the bottom yoke of the magnetic core.

BRIEF DESCRIPTION OF THE DRAWING

The various features, advantages and other uses of this invention will become more apparent by referring to the following detailed description and drawing in which.

DESCRIPTION OF THE PREFERRED EMBODIMENT

Throughout the following description, identical reference numbers are used to refer to the same component in all figures of the drawings.

Figure 1:
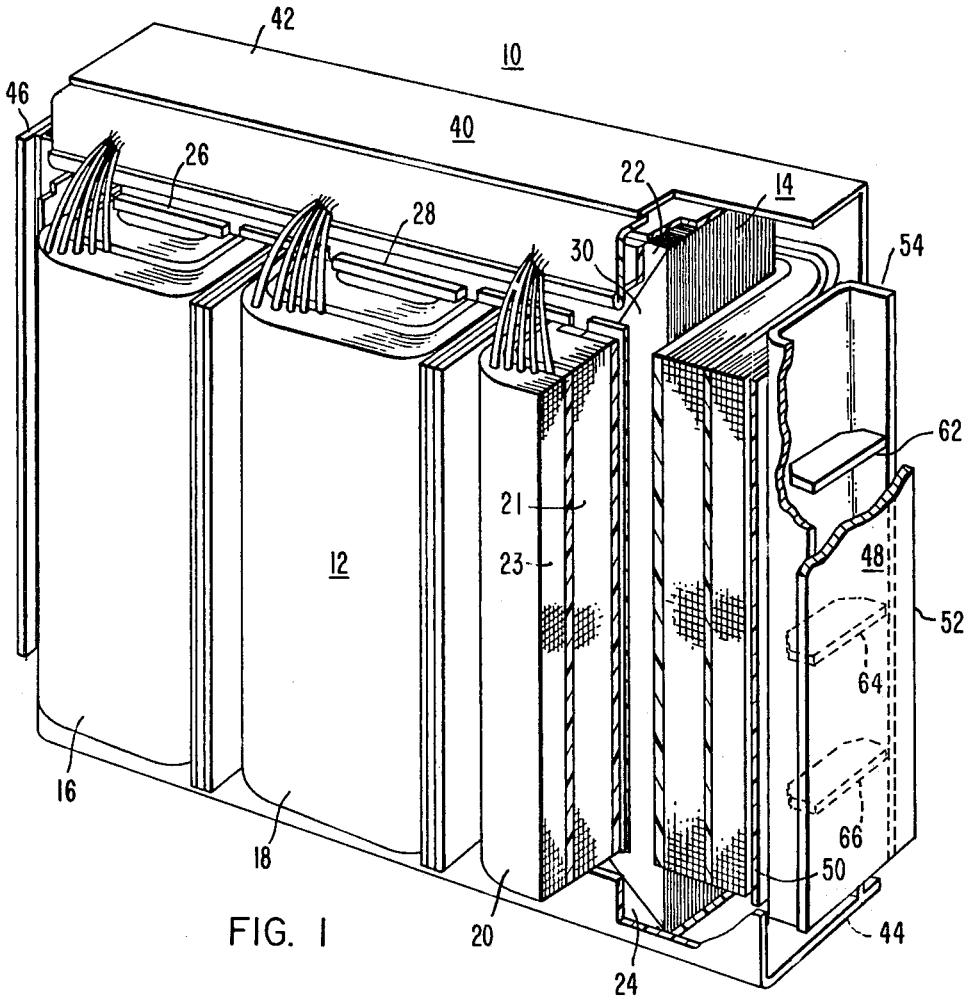
FIG. 1 is a perspective view of an electrical inductive apparatus constructed according to the teachings of this invention.

Referring now to the drawings, and to FIG. 1 in particular, there is shown a three phase transformer 10 constructed according to the teachings of this invention. The transformer 10 includes a magnetic core and coil assembly 12 which consists of phase winding assemblies 16, 18 and 20 disposed in inductive relation around a magnetic core 14. The magnetic core 14 is constructed of a plurality of laminations of suitable magnetic material and includes a top yoke portion 22, a bottom yoke portion 24 and leg portions 26, 28 and 30 which are connected to the top and bottom yoke portions 22 and 24 to form the magnetic core 14. According to the preferred embodiment of this invention, the mitered ends of the leg and yoke portions of the magnetic core 14 are joined together in a so-called "stepped-lap" joint wherein the joint between the mitered or diagonally cut ends of the leg and yoke laminations, in each layer of the laminations, is incrementally offset from similarly located joints in adjacent layers, in a predetermined stepped or progressive pattern. In addition, the leg portions 26, 28 and 30 of the magnetic core 14 have a substantially rectangular cross-sectional configuration.

The winding assemblies 16, 18 and 20 are axially disposed in inductive relation around the leg portions 26, 28 and 30, respectively, of the magnetic core 14. Each of the winding assemblies 16, 18 and 20 includes a low voltage and a high voltage winding, of either sheet or strap type conductors, which form a plurality of turns around each respective leg portion of the magnetic core 14. In addition, the phase winding assemblies, 16, 18 and 20 are tightly wound around each leg portion of the magnetic core 14 in a substantially rectangular cross-sectional configuration. For clarity, the bushings and leads normally used to connect the high and low voltage windings of the winding assemblies to an external electrical circuit are not shown.

The core and coil assembly 12 is held rigidly in position by a suitable support structure 40 formed of upper and lower end frames 42 and 44, respectively, and first and second end plate assemblies 46 and 48, respectively, which are joined together to provide a rigid structure that resists movement of the windings during the operation of the transformer 10. The upper and lower end frames 42 and 44, each of which consists of two members joined together in a substantially U-shaped cross-sectional configuration, are disposed in registry with the top and bottom yokes 22 and 24 of the magnetic core 14. The individual components of the top and bottom end frames 42 and 44 are welded together under pressure to form a rigid structure that exerts a clamping action on the top and bottom yokes 22 and 24 of the magnetic core 14. This clamping action not only holds the laminations of the magnetic core 14 firmly in place but also provides sound attenuation advantages for the transformer 10. The first and second end plate assemblies 46 and 48 are welded at their top and bottom ends to the upper and lower end frames 42 and 46, respectively, to form a solid support structure for the magnetic core and coil assembly 12. The first and second end plate assemblies 46 and 48 are each disposed in registry with a portion of the outermost turn of the winding, in general the wide flat part of the rectangularly configured windings of the outermost winding assemblies of the magnetic core and coil assembly 12, such as coil assemblies 16 and 20. Although the end plate assemblies are described as being in registry with the winding, it is understood that suitable insulation, such as insulative sheet 50 for end plate assembly 48, is disposed between the windings and each end plate assembly.

During its operation, an electrical inductive apparatus, such as transformer 10, is subjected to severe forces incident to short circuit and transient conditions. Since a conventionally constructed transformer has the low voltage winding concentrically disposed innermost of the high voltage winding, these severe forces tend to force the low voltage winding inward against the leg of the magnetic core and the high voltage winding in an outward direction. In a transformer having core and coils with a rectangular cross-sectional configuration, these forces cause the windings to round out from their original rectangular shape. The trend toward higher electrical distribution system voltages has resulted in an increase in these forces acting upon the transformer during short circuit and transient conditions thus requiring increased strength and rigidity in the support structure, and in particular the end plate assemblies, to prevent movement of the magnetic core and coils. With prior art constructions wherein the end plate consisted of a thick steel slab or plate, increased strength could be provided by merely increasing the thickness of each plate or slab. However, this significantly increases the overall weight of the transformer which results in increased shipping costs and handling problems.

Figure 3:
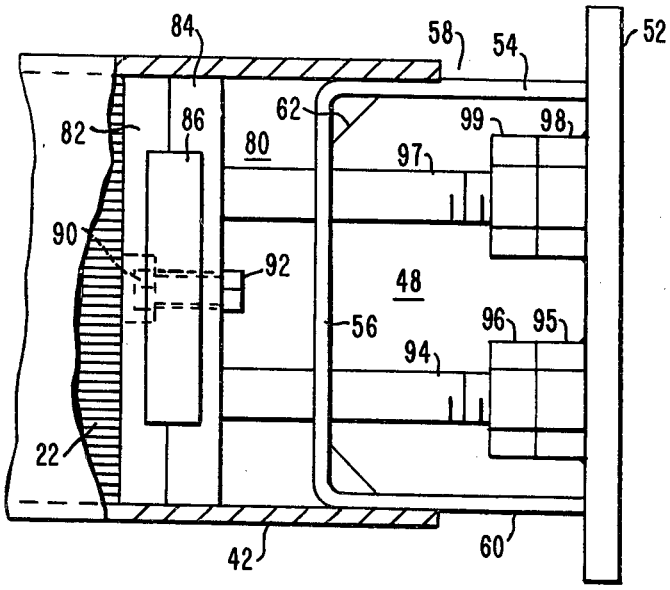
FIG. 3 is a sectional view generally taken along line III—III in FIG. 2.
Figure 2:
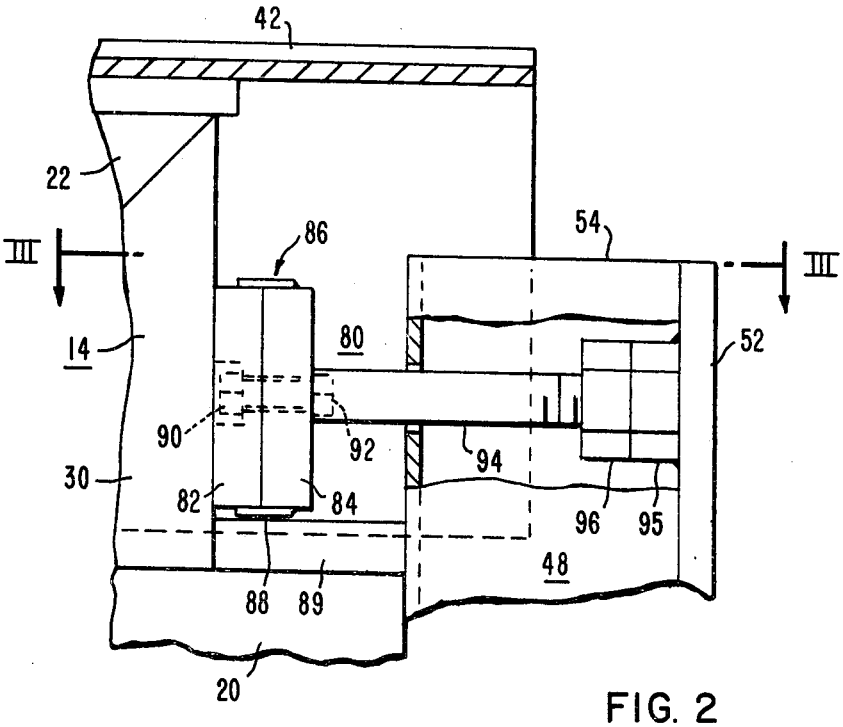
FIG. 2 is a partial elevational view of an upper core brace constructed according to another embodiment of this invention.

There is shown in a portion of FIGS. 1, 2 and 3 a support structure having an improved end plate assembly which provides the necessary increased strength and rigidity without a corresponding increase in weight. Since the end plate assemblies 46 and 48, shown in FIG. 1, are identical, only end plate assembly 48 will be described in detail hereafter. In addition, it will be noted that, although the following description of the preferred embodiment of this invention describes the end plates as constructed of two members joined together in a tubular cross-sectional configuration, other constructions including the use of a single rectangular or square tubular member with a hollow box section formed therein are also within the scope of this invention.

Accordingly, end plate assembly 48 includes an axially extending plate member 52 having a substantially rectangular cross-sectional configuration. The rectangular plate member 52, according to preferred embodiment of this invention, is constructed of a suitable material, such as steel, and is axially disposed with its inner surface facing the core and coil assembly 12. The end plate assembly 48 further includes an axially extending channel member 54 which has a U-shaped cross-sectional configuration. As shown more clearly in FIG. 3, the channel member 54 includes an end portion 56, which is disposed in registry with the outermost turn of the winding assembly 20, and leg portions 58 and 60, one end of which are joined to the inner surface of the rectangular plate member 52 by suitable means, such as by welding. The upper and lower portions of the channel member 54 fit within the respective top and bottom end frames 42 and 44 and are welded thereto to form the support structure 40.

The configuration of the plate and channel 52 and 54 of the end plate assembly 48 provides a strong and rigid support structure that resists movement and rounding out of the winding assembly 20 during forces incident to short circuit and transient conditions. Additional rigidity is provided for the end plate assembly 48 by a plurality of axially spaced ribs, such as ribs 62, 64 and 66 shown in FIG. 1. The ribs, such as rib 62 shown in greater detail in FIG. 3, are disposed between the plate and channel members 52 and 54 of the end plate assembly 48 and substantially fill the opening or channel therebetween. Each rib is joined to the U-shaped channel member by suitable means, such as by welding, to provide additional support for the channel member 54 that resists the movement or rounding of the U-shaped channel member 54 during the operation of the transformer 10. The use of several components welded together to form the end plate assembly simplifies assembly of the end plate assembly since the components are readily available in the desired sizes which eliminates additional machining operations and furthermore, the ribs can be easily inserted during the assembly of the end plate assembly.

The tubular or box cross-sectional configuration of the novel end plate assembly described above has substantially higher bending strength per unit weight than the prior art slab-type end plate assemblies. Thus, the tubular cross-sectional end plate assembly can provide the increased bending strength necessary to resist movement of the winding of a transformer having a higher rating than commonly used before without the objectionable weight increase that would result from increasing the thickness of a prior art slab-type end plate in order to provide the same bending strength. Additional strength and rigidity can be provided by merely increasing the depth, or length, of the legs of the U-shaped channel member 54 which does not significantly increase the weight of the end plate nor necessitate an increase in the overall size of the transformer. In addition, the rounded corners between the flat portion 56 and the legs 58 and 60 of the channel member 54 of the end plate assembly 48 resist corona inception due to the rounded or smooth surface exposed to the conducting elements of the transformer 10. The slab type prior art end plates require extensive surface conditioning or machining to round off the sharp corners and thereby prevent corona inception at these points.

Referring now to FIGS. 2, 3, 4 and 5, there is shown another embodiment of this invention wherein unique upper and lower core braces 80 and 100, respectively, are provided to prevent movement of the magnetic core 14 of the transformer 10 under forces incident to short circuit and transient conditions. The recent trend to higher distribution system voltages and the resulting increase in transformer ratings presents several problems which adversely affect the performance of a transformer having a stacked magnetic core and rectangular coils. The increased forces acting upon the transformer, such as those incident to short circuit and transient conditions, cause movement or separation of the leg portions from the upper and lower yoke portions of the magnetic core, such as leg portion 30 from the upper and lower yoke portions 42 and 44 of the magnetic core 14 shown in FIG. 1, which adversely affects the electrical characteristics of the transformer. It is felt that the forces acting upon the rectangular windings of a multiphase transformer, which are disposed adjacent and in registry with each other, result in a movement or separation of the leg portions, and in particular the outermost leg portions, such as legs 26 and 30 shown in FIG. 1, from the yokes of the magnetic core 14.

In order to maintain the mechanical and electrical integrity of the magnetic core of a transformer, unique core braces, such as upper core brace 80 and lower core brace 100, are provided. Referring to FIGS. 1, 2 and 3, there is shown an upper core brace 80 constructed according to the teachings of this invention. For clarity, the detailed construction of one upper core brace, such as upper core brace 80 associated with core leg 30, winding assembly 20 and end plate assembly 48, will be described hereafter; it being understood that an identical upper core brace will be disposed at the opposite end of the transformer. Accordingly, upper core brace 80 is situated above phase winding assembly 20 and is connected between core leg 30 of the magnetic core 14 and the end plate assembly 48. Upper core brace 80 includes a first member or plate 82 which is constructed of suitable electrically insulating material, such as one sold commercially under the tradename "MICARTA", and is disposed in registry with the core leg 30 to insulate the remainder of the upper core brace 80 from the magnetic core 14 of the transformer. An identically shaped second plate member 84, constructed of a suitably strong material, such as steel, is disposed contiguous with the first member 82. First and second bars 86 and 88 are provided above and below the first and second members 82 and 84 and joined to the second member 84 by suitable means, such as by welding, not shown, to hold the first and second members 82 and 84 in position. In addition, suitable joining means, such as the nut and bolt 90 and 92, are provided to hold the first and second members 82 and 84 together during the construction of the core brace 80. As shown in FIG. 2, bar 88 is disposed below the first and second members 82 and 84 and rests on an upper coil block 89 which is typically constructed of an insulating material, such as wood, and provides additional bracing to prevent movement of the winding assembly 20 during the operation of the transformer.

Suitable connecting means, such as rods 94 and 97, are provided to connect the first and second members 82 and 84 of the upper core brace 80 to the end plate assembly 48. Each rod 94 and 97 has a plurality of external threads on at least the portion thereof that is adjacent the end plate assembly 48. The opposite end of each rod 94 and 97 is joined to the second member 84 by suitable means, such as by a weld, not shown. The connecting means further includes adjusting means, such as nuts 95 and 96 associated with rod 94 and nuts 98 and 99 associated with rod 97, which allow adjustments to be made during the assembly of the upper core brace 80 which simplify construction of the brace. The rods 94 and 97 of the upper core brace 80 are inserted through slots, not shown, in the end portion 56 of the U-shaped channel member 54 of the end plate assembly 48 prior to the threading of the nuts 95, 96, 98 and 99 thereon and, also, before the end plate assembly 48 is placed between and welded to the upper and lower end frames 42 and 44, respectively. After the top and bottom ends of the end plate assembly 48 are welded to the top and bottom end frames 42 and 44, the nuts 95, 96, 98 and 99 are threaded onto the respective rods 94 and 97 and rotated until the core brace 80 presses against the core leg 30 of the magnetic core 14 at which time the first member 82 of the upper core brace 80 will be in registry with the core leg 30 and the nuts 95 and 98 will be in registry with the inner surface of the rectangular plate member 52 of the end plate assembly 48. The nuts 96 and 99 are then threaded in a direction toward nuts 95 and 98, respectively, until they are in registry therewith; at which time all of the nuts 95, 96, 98 and 99 are then secured or locked into position by suitable means, such as by welding, to hold the core brace 80 in position and thereby provide a rigid structure that resists movement or separation of the core leg 30 from the upper yoke portion 22 of the magnetic core 14. The use of additional nuts 96 and 99 in conjunction with nuts 95 and 98, respectively, insures that at least one nut will be fully threaded onto each rod 94 and 97.

The unique core brace 80 described above cooperates with the end plate assembly 48 to prevent movement or separation of the leg portion from the yoke portions of the magnetic core of the transformer. In addition, the combination of the upper core brace 80 and unique end plate assembly 48 reduces the possibility that weld splatter from the assembly of these components will enter or fall into the core and coil assembly 12 of the transformer 10 and cause problems, such as a short circuit, during the operation of the transformer 10, since the welding of the core brace 80 into position is done within the two members of the end plate assembly 48, and not directly over the core and coil assembly 12. Furthermore, the assembly of the upper core brace 80 is simplified since it can be adjusted and secured in its final position without time consuming machining operations or close control of manufacturing tolerances.

Figure 5:
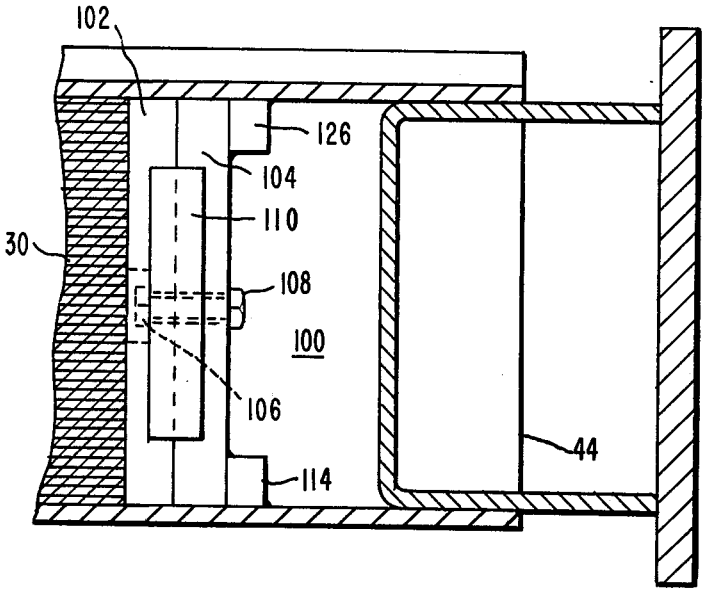
FIG. 5 is a sectional view generally taken along line V—V in FIG. 4.
Figure 4:
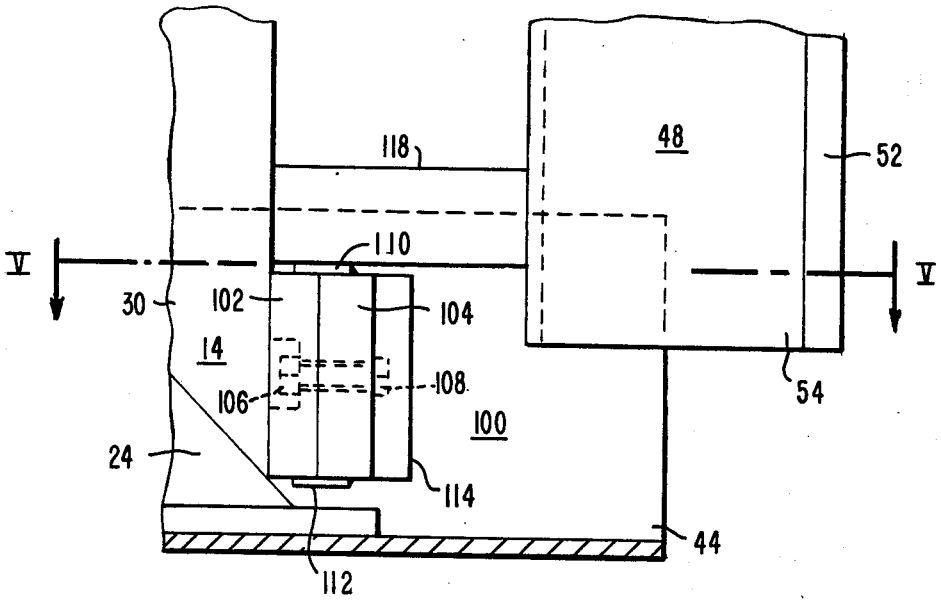
FIG. 4 is a partial elevational view of a lower core brace constructed according to another embodiment of this invention.

Referring now to FIGS. 4 and 5, there is shown a novel lower core brace 100 which is disposed beneath the outermost winding assemblies, such as winding assemblies 16 and 20 of the transformer 10, to prevent movement or separation of the core legs from the lower yoke 24 of the magnetic core 14. As with the upper core braces 80, identical lower core braces are utilized at the joint between the outermost leg, such as legs 26 and 30 of the magnetic core 14 and the bottom yoke portion 24 of the magnetic core 14 and for clarity purposes, only one lower core brace will be described in detail hereinafter. Accordingly, core brace 100 includes an insulating member 102 constructed of suitable electrically insulating material, such as one sold commercially under the tradename "MICARTA", which is disposed in registry with the lower portion of the core leg 30 of the magnetic core 14. An identically shaped steel member 104 is disposed adjacent to the insulating member 102 and secured thereto by suitable joining means, such as by nut and bolt 106 and 108. Upper and lower bars 110 and 112 are disposed above and below the insulating member and the steel members 102 and 104 and secured to the steel member 104 by suitable joining means, such as by welding, not shown, in order to maintain the two members 102 and 104 in position during the assembly of the lower core brace 100. In assembling the lower core brace 100, the insulating member 102 and the steel member 104 are secured together by the nut and bolt 106 and 108 with the upper and lower bars 110 and 112 attached to the steel member 104 to hold the components in position. Securing members or bars 114 and 126 are then joined to the outer surface of the steel member 104 by suitable means, such as by tack welding. The completed assembly is then inserted within the bottom end frame 44 prior to the loading of the winding assembly 20 onto the core leg 30 and moved or pressed into position until the insulating member 102 is in registry with the core leg 30 and the upper bar 110 is in contact with the lower coil block 118 which is used to provide support for the outermost portion of the winding assembly 20. Suitable joining means, such as welds, are then applied to the securing members 114 and 126 to join the lower core brace 110 to the bottom end frame 44, and thereby provide a solid brace which prevents movement or separation of the lower portion of the core leg 30 from the bottom yoke 24 of the magnetic core 14 during the operation of the transformer 10.

It will be apparent to one skilled in the art that there has been herein disclosed an electrical inductive apparatus, such as an electrical transformer, having improved support structure that resists movement of the core and coils during forces incident to short circuit and transient conditions. The support structure includes novel end plate assemblies, each having a substantially tubular cross-sectional configuration, which provide sufficient bending strength and rigidity to resist movement and rounding out of the winding during the operation of the transformer. By providing a support structure having increased strength, the short circuit withstand capability of a transformer is improved, thereby enabling a transformer, and especially one having rectangular core and coils, to be constructed with a higher rating than previously possible. In addition, the bending strength of the end plate assembly may be increased for use in transformers having higher than normal ratings merely by increasing the depth of the tubular member instead of increasing the thickness of the slab type end plates utilized in prior art construction; which technique, therefor, does not substantially increase the weight or the overall size of the transformer. In addition, the use of a tubular end plate assembly resists corona inception since the end plate assembly presents rounded corners or edges to the conducting elements of the transformer which, thereby eliminates the need for extensive surface conditioning necessary for the sharp corners of the prior art slab type end plates.

It will also be apparent that the novel core braces disposed above and below the winding at the joints between the outermost leg and yoke portions of the magnetic core of the transformer resist movement or separation of the leg portions from the yokes thereby preventing degradation of the electrical characteristics of the transformer. The unique upper core brace disclosed herein interacts with the end plate assembly to allow adjustments of the core brace during its assembly which simplifies construction and reduces the possibility that weld splatter from the assembly of the core brace will enter the core and coil assembly and cause problems therein since the welding necessary to assemble these components is done within the end plate assembly and not directly over the core and coil assembly.

What we claim is:

1. Electrical inductive apparatus comprising:

a magnetic core having at least first and second vertically extending leg portions of substantially rectangular cross-sectional configuration connected by upper and lower yokes, said leg and yoke portions being formed of a plurality of laminations of magnetic material;

first and second electrical winding assemblies axially disposed in inductive relation with said first and second leg portions of said magnetic core, respectively, said first and second electrical winding assemblies each having a substantially rectangular cross-sectional configuration and being subject to radial forces incident to a short circuit;

an upper end frame disposed to clamp said upper yoke of said magnetic core;

a lower end frame disposed to clamp said lower yoke of said magnetic core; and first and second vertically extending end plates disposed in registry with said first and second electrical winding assemblies, respectively, and connected at their top and bottom ends to opposing ends of said upper and lower end frames to form a solid support structure for said magnetic core and said electrical winding assemblies;

said first and second end plates having a substantially tubular cross-sectional configuration formed of first and second leg portions and first and second end portions that provides a strong and lightweight support structure that resists movement of said electrical winding assemblies due to said radial forces incident to a short circuit.

2. The electrical inductive apparatus of claim 1 wherein the first and second end plates each include a vertically extending plate member and a vertically extending channel member having end and leg portions, said leg portions joined on one end thereof by said end portion which is disposed adjacent to the electrical winding assembly and on the other end of said plate member to provide a substantially tubular cross-sectional configuration.

3. The electrical inductive apparatus of claim 2 wherein each of the first and second plates further includes at least one rib member disposed within the channel member for resisting movement of said channel member relative to said plate member.

4. The electrical inductive apparatus of claim 1 further including upper core bracing means for resisting movement of the first and second legs of the magnetic core relative to the upper yoke of said magnetic core in a direction parallel to the plane of the core laminations, said upper core bracing means disposed in registry between the edges of the upper portions of said first and second legs of said magnetic core and the first and second end plates, respectively.

5. The electrical inductive apparatus of claim 4 wherein the upper core bracing means includes:

a first plate member, formed of electrically insulating material, and having one side thereof disposed in registry with one of the leg portions of the magnetic core;

a second plate member joined to the other side of said first member;

connecting means disposed between said second plate member and one of the first and second end plates; and means, disposed in registry with said one of said first and second end plates, for extending said connecting means relative to said end plate to force said first and second plate members against said leg portion of said magnetic core and, thereby, provide a rigid brace between said leg portion of said magnetic core and said end plate which resists movement of said leg portion relative to the yoke portion of said magnetic core during the operation of said electrical inductive apparatus.

6. Electrical inductive apparatus of claim 5 wherein the connecting means is a rod joined to the second plate member on one end and having a plurality of external threads adjacent the other end thereof and wherein the extending means includes at least one nut disposed in registry with the end plate and engageable with said threads on said rod such that rotation of said nut in one direction extends said rod relative to said end plate.

7. The electrical inductive apparatus of claim 4 further including lower core bracing means disposed between the lower portions of the first and second legs of the magnetic core and the lower end frame, said lower core bracing means including:

a third plate member formed of electrically insulating material and having one side thereof disposed in registry with one of said first and second leg portions of said magnetic core;

a fourth plate member joined to the other side of said third plate member, and means for joining said fourth plate means to said lower end frame to securely hold said lower core brace means in position and provide a rigid brace that resists movement of the lower portion of said leg portion relative to the yoke portion of said magnetic core in a direction parallel to the plane of the core laminations.

* * * * *